US005395402A

United States Patent [19]

Duckett

[11] Patent Number: 5,395,402

[45] Date of Patent: Mar. 7, 1995

[54] FORMALDEHYDE-FREE AQUEOUS COMPOSITION, METHOD OF TREATING A FABRIC THEREWITH AND FABRIC OBTAINED BY SAID TREATMENT SUITABLE FOR USE AS A WINDOW TREATMENT

[75] Inventor: Charles W. Duckett, Kernersville, N.C.

[73] Assignee: Precision Fabrics Group, Inc., Greensboro, N.C.

[21] Appl. No.: 818,082

[22] Filed: Jan. 8, 1992

[51] Int. Cl.[6] ..... D06M 15/15

[52] U.S. Cl. ..... 8/115.6; 8/115.56; 525/187

[58] Field of Search ..... 8/115.6, 115.7, 115.56; 526/273, 317; 525/187

[56] References Cited

U.S. PATENT DOCUMENTS

| | | | |
|---|---|---|---|
| 3,425,981 | 2/1969 | Puletti et al. | 525/187 |
| 3,475,519 | 10/1969 | Noland et al. | 525/187 |
| 3,554,953 | 1/1971 | Duchesneau, Jr. et al. | 525/187 |
| 3,590,101 | 6/1971 | McTaggart et al. | 525/187 |
| 3,655,830 | 4/1972 | Smith | 525/187 |
| 3,908,049 | 9/1975 | Fitko | 427/386 |
| 4,081,383 | 3/1978 | Warburton, Jr. et al. | 252/8.6 |
| 4,289,811 | 9/1981 | Shelly, Jr. | 427/386 |
| 4,315,044 | 2/1982 | Elmone et al. | 427/386 |
| 4,325,857 | 4/1982 | Champaneria et al. | 523/412 |
| 4,477,610 | 10/1984 | Ishimura et al. | 523/414 |
| 4,702,861 | 10/1987 | Franum | 8/115.6 |
| 4,743,244 | 5/1988 | LeKhac | 604/376 |
| 4,912,149 | 3/1990 | Robeson et al. | 524/501 |

*Primary Examiner*—Prince Willis, Jr.
*Assistant Examiner*—J. Silbermann
*Attorney, Agent, or Firm*—Finnegan, Henderson, Farabow, Garrett & Dunner

[57] ABSTRACT

A formaldehyde-free composition for finishing fabrics, the use thereof, and the fabrics obtained thereby are disclosed, the finishing composition being an aqueous dispersion containing from 10–50% by weight of a polymeric resin binder such as a carboxy-modified polymer, 1–10% by weight of an aqueous-dispersible epoxy resin or blend of said resin with another thermosetting resin and one or more additives such as surfactants, delustrants, antistatic agents, flame retardants, fillers, thickeners, catalysts, as needed.

12 Claims, No Drawings

FORMALDEHYDE-FREE AQUEOUS COMPOSITION, METHOD OF TREATING A FABRIC THEREWITH AND FABRIC OBTAINED BY SAID TREATMENT SUITABLE FOR USE AS A WINDOW TREATMENT

BACKGROUND OF THE INVENTION

1. Field of the Invention

This invention comprises a formaldehyde-free aqueous composition for finishing a fabric, a method for finishing a fabric using the formaldehyde-free composition, and the formaldehyde-free fabric obtained thereby.

Importantly, the formaldehyde-free composition of the present invention provides a treated, finished fabric with a rigid stiffness. The treated fabric is heat and light stable and non-tacky, enabling the fabric to be transfer printed and used in window treatments such as pleated window shades and vertical blinds.

2. Description of the Prior Art

Presently, window treatment fabrics are customarily dyed, printed, and/or metallized with a finish process with one or more of the finishing compositions containing formaldehyde. Hereto-fore, it has been believed that formaldehyde is a necessary ingredient in the finish composition in order to produce the stiffness and rigidity in the fabric necessary to make window treatments such as pleated window shades and vertical blinds.

Pleated window blinds may be produced by various methods known in the art in which the fabric may be dyed and finished; finished, metallized on back, and transfer printed; finished, metallized on back, transfer coated and printed; finished, transfer printed and laminated; or dyed, finished and laminated. The fabric may also be finished, wet printed (solvent or aqueous solution) and/or metallized. Vertical blinds may also be produced by similar methods.

Commonly, the finished fabric that is used in window treatments contains formaldehyde releasing resins such as melamine formaldehyde, urea formaldehyde, glyoxal reactants and mixtures thereof. Based on the chemical nature of these resins, formalde-hyde gases are released during and after each process as described above and have been determined to be hazardous to the health of workers by OSHA. The formaldehyde gases are also released over a long period of time after the final product has been made and purchased by the customer.

Because of the need for a formaldehyde-free window treatment, a finished fabric has been developed that is non-hazardous, but retains the properties, especially stiffness, which is customary in a formaldehyde-containing product. Replacing the thermoset resin containing formaldehyde with a formaldehyde-free thermoset resin product eliminates the hazardous formaldehyde gas that is retained in the fabric and eliminates the hazardous formaldehyde gas that is given off in the pleating and printing process. The improved finish described herein thus allows the fabric to be used without releasing formaldehyde gases that are hazardous to human health both in the workplace and in the home while retaining the properties necessary to make successful window treatments.

SUMMARY OF THE INVENTION

A formaldehyde-free composition for finishing fabric is provided which renders a fabric treated therewith suitable for window treatments. The formaldehyde free aqueous composition comprises an aqueous dispersion containing a polymeric resin binder and a water dispersible epoxy resin or a blend of said epoxy resin with another thermosetting resin. The composition further comprises one or more additives selected from the group consisting of a surfactant, a delustrant, an optical brightener, an antistatic agent, a flame retardant, a filler, a thickener and a catalyst.

The present invention also relates to a method of using the finish composition wherein a yarn or a fabric such as a knit, woven or non-woven fabric with suitable construction for use in window treatments is pad-dipped through the finish composition and dried, preferably after being scoured, heat set, and/or dyed.

The present invention further relates to fabric obtained in accordance with the finishing process described above which renders it useful in making pleated window blinds and vertical blinds.

DESCRIPTION OF THE PREFERRED EMBODIMENTS

The chemical composition of the formaldehyde-free aqueous composition is a major feature of the invention. The composition comprises an aqueous dispersion containing from 10–50% by weight of a polymeric resin binder and 1–10% by weight of a water dispersible epoxy resin or a blend of said epoxy resin with another thermosetting resin. The composition further comprises one or more additives selected from the group consisting of a surfactant, a delustrant, an optical brightener, a flame retardant, an antistatic agent, a filler, a thickener and a catalyst.

The polymeric resin binder is a primary component of the finish composition and may be selected from the group consisting of an acrylic resin, a polyvinyl acetate, a polyvinyl chloride, a polyvinyl alcohol, a polystyrene, and mixtures thereof. A carboxy-modified acrylic resin is a preferred binder.

The thermosetting resin is the major component of the finish composition. One preferred thermosetting resin is an epoxy resin, e.g., a bisphenol-A type epoxy resin, or a blend of epoxy resins, at least one of which is an aqueous-dispersible bisphenol A type, with another thermosetting resin. The thermosetting resin may be incorporated into the formaldehyde-free adqueous composition in the form of a non-ionic aqueous dispersion. One advantage of the aqueous-dispersible bisphenol type A resin is that it is completely water reducible.

One or more additives may be contained in the formaldehyde-free aqueous composition as necessary, such as a surfactant, a filler, a delustrant, an antistat, a catalyst, a thickener, an optical brightener and mixtures of these, each in an amount of 0–10% by weight of the composition. A flame retardant may be added in an amount of 0–50% by weight of the composition.

Exemplary components of the formaldehyde-free aqueous composition are listed below with corresponding trade names and suppliers as available.

| COMPONENT | % BY WEIGHT | TRADE NAME/SUPPLIERS | |
|---|---|---|---|
| POLYMERIC RESIN BINDER | 10–50% | HYCAR 26315 | B. F. GOODRICH |
| | | RHOPLEX E-1782 | ROHM & HAAS |
| EPOXY RESIN COMPONENT | 1–10% | EPI-REZ 35201 | RHONE-POULENC |
| | | EPI-REZ W55-5003 | RHONE-POULENC |
| | | RDX 61010 | RHONE-POULENC |
| SURFACTANT | 0–10% | DEXOPAL 555 | DEXTER CHEMICAL |
| | | ISOPROPANOL | ASHLAND CHEMICMI |
| DELUSTRANT | 0–10% | LIGHT DULLER NF | SYBRON CHEMICAL |
| | | COLLOIDAL SILICA | NYACOL PRODUCTS |
| ANTISTAT | 0–10% | ZELEC TY | DUPONT |
| | | ASTON 123 | RHONE-POULENC |
| FLAME RETARDANT | 0–50% | ANTIBLAZE 19 | ALBRIGHT & WILSON |
| | | FLAMEGARD P.E. | SYBRON CHEMICAL |
| FILLER | 0–10% | R-900 $TIO_2$ | DUPONT |
| | | COLLOIDAL SILICA | HYACOL PRODUCTS |
| THICKENER | 0–10% | ACRYSOL G110 | ROHM & HAAS |
| | | ACRYSOL ASE-60 | ROHM & HAAS |
| CATALYST | 0–10% | ACCELERATOR UTX | AMERICAN CYANAMID |
| | | EPI-CURE 826 | RHONE-POULENC |
| OPTICAL BRIGHTENER | 0–5% | UVITEX EBF | CIBA-GEIGY |

The fabric used in the present invention can be any suitable fabric, particularly a woven or knitted substrate, that can be utilized in window treatments. If woven, the fabric may consist of several different weaves, such as plain, satin, twill, crepe, dobby, or other suitable weaves. Knit fabric suitable for window treatments may also be used. The fabric may also contain different colored yarns in the warp and filling (courses and wales for knits) such as white warp and filling, colored warp and filling, white warp and colored filling and colored warp and white filling. One suitable fabric primarily contains polyester yarn ranging from 40 to 300 denier in warp and fill direction. Blends of polyester and other fibers may also be used. These yarns may be natural or colored and in a warp and/or fill direction.

After the formaldehyde-free aqueous composition has been prepared, the composition is applied to the fabric, e.g. by a finishing process involving a pad/dry system. In this system, the fabric is pad-dipped into the finish composition and then dried, e.g., in a tenter oven. This drying step is normally carried out at approximately 350° to 450° F. for approximately 20 to 60 seconds.

After the fabric has been finished, it is ready for printing and pleating if desired. The printing may be conducted by way of a heat transfer process whereby the color is transferred from paper to fabric. Pleating is a mechanical process using heat, pressure and tension in which fabric is folded upon itself into an accordion-like configuration followed by placing the fabric in a heated chamber to set the configuration permanently.

These and other features of the present invention are additionally illustrated in connection with the following examples, which are to be considered as illustrative of the present invention. It should be understood, however, that the invention is not limited to the specific details of the following examples.

EXAMPLE I

A woven polyester fabric using white yarn with 70 denier in the warp direction and 50 denier in the filling direction was used in this example. The fabric had a satin weave with a round count of 256 and greige weight of 2.35 ounces per square yard. The fabric was scoured, dried, and then finished.

The treating composition was comprised of the following:

| | | |
|---|---|---|
| RHOPLEX E 2321 | CARBOXY-MODIFIED ACRYLIC BINDER | 20% BY WEIGHT |
| EPI-REZ 35201 | EPOXY RESIN | 10% BY WEIGHT |
| LIGHT DULLER | DELUSTRANT | 2% BY WEIGHT |
| ZELEC TY | ANTISTAT AGENT | 2% BY WEIGHT |
| ISOPRO-PANOL | SURFACTANT | 2% BY WEIGHT |
| | WATER | 74% BY WEIGHT |

The fabric was pad-dipped through the treating composition then dried at 420° F. for 40 seconds in a tenter frame oven. After drying, the finished fabric was printed and pleated. The printing was conducted by way of a heat transfer process, whereby the color was transferred from paper to the fabric at 400° to 410° F. Pleat-ing was carried out by folding the fabric upon itself into an accordion shape followed by treating the fabric at 280° to 300° F. for approximately 30 minutes in a heated chamber. The fabric was then assembled into pleated window blinds.

EXAMPLE II

A woven polyester fabric using white yarn with 70 denier in both the warp and filling direction was used. The fabric had a damask fancy weave with a round count of 235 and greige weight of 2.51 ounces per square yard. The fabric was scoured, dyed, dried, and then finished.

The treating composition was comprised of the following:

| | | |
|---|---|---|
| RHOPLEX E-2321 | CARBOXY-MODIFIED ACRYLIC BINDER | 20% BY WEIGHT |
| EPI-REZ 35201 | EPOXY RESIN | 5% BY WEIGHT |
| LIGHT DULLER NF | DELUSTRANT | 2% BY WEIGHT |
| ZELEC TY | ANTISTAT AGENT | 2% BY WEIGHT |
| ISOPRO-PANOL | SURFACTANT | 2% BY WEIGHT |
| | WATER | 69% BY WEIGHT |

The fabric was pad-dipped through the treating composition then dried at 400° F. for 30 seconds in a tenter frame oven. After the fabric was finished, it was hot slit into 3½" strips or gains in the warp direction. The strips were then assembled into vertical blinds.

The finished fabric of the present invention is pleatable with even, non-puckering pleats, has good pleat retention, and a suitable stack height and weight for use as a pleated window blind. The finished fabric is non-tacky, stable to light and heat, and is non-curling for both pleated window blinds and vertical blinds. If the fabric is to be transfer printed, the finished fabric is capable of accepting transfer printing evenly with efficient color development and has good light and heat stability properties after printing.

The principles, preferred embodiments and modes of operation of the present invention have been described in the foregoing specification. The invention, which is intended to be protected herein, is not to be construed as limited to the particulars disclosed, since these are to be regarded as illustrative rather than restrictive. Variations and changes may be made by those skilled in the art, without departing from the spirit of the invention.

What is claimed is:

1. A method of finishing a polyester yarn or fabric which comprises the steps of (a) treating the yarn or fabric by applying thereto a formaldehyde-free aqueous composition and (b) drying the treated yarn or fabric at a temperature of about 350°–450° F. for 20 to 60 seconds;

wherein the formaldehyde-free aqueous composition comprises an aqueous dispersion containing:

from 10–15% by weight of a polymeric resin binder selected from the group consisting of an acrylic resin, a polyvinyl chloride, a polyvinyl alcohol, a polyvinyl acetate, a polystyrene, and a mixture thereof; and 1–10% by weight of a water dispersible thermosetting resin comprising an epoxy resin containing bisphenol-A or a blend of said epoxy resin containing bisphenol-A with another thermosetting resin which is not the same as said epoxy resin containing bisphenol-A.

2. The method according to claim 1 wherein the formaldehyde-free aqueous composition further comprises one or more additives selected from the group consisting of a surfactant, a delustrant, an optical brightener, a flame retardant, an antistatic agent, a filler, a thickener and a catalyst, each of said additives, with the exception of said flame retardant, being in an amount of 0–10% by weight of the composition and said flame retardant being in an amount of 0–50% by weight of the composition.

3. Polyester fabric finished with a formaldehyde-free aqueous composition comprising an aqueous dispersion containing:

from 10–50% by weight of a polymeric resin binder selected from the group consisting of an acrylic resin, a polyvinyl chloride, a polyvinyl alcohol, a polyvinyl acetate, a polystyrene, and a mixture thereof; and 1–10% by weight of a water dispersible thermosetting resin comprising an epoxy resin containing bisphenol-A or a blend of said epoxy resin containing bisphenol-A with another thermosetting resin which is not the same as said epoxy resin containing bisphenol-A.

4. Fabric according to claim 3 wherein the formaldehyde-free aqueous composition further comprises one or more additives selected from the group consisting of a surfactant, a delustrant, an optical brightener, a flame retardant, an antistatic agent, a filler, a thickener and a catalyst, each of said additives, with the exception of said flame retardant, being in an amount of 0–10% by weight of the composition and said flame retardant being in an amount of 0–50% by weight of the composition.

5. Fabric according to claim 3 wherein the fabric is printed by a heat transfer process and pleated, the pleats being set by exposing the pleated fabric to a temperature of 225° to 300° F. for approximately 30 minutes.

6. Fabric according to claim 3 wherein the finished fabric is hot slit into strips for assembly into vertical blinds.

7. Fabric according to claim 3 comprising yarn having a denier ranging from 40 to 300 in the warp and fill directions.

8. The fabric according to claim 3 wherein said polymeric resin binder is a carboxy-modified acrylic resin.

9. A formaldehyde-free aqueous composition for finishing a polyester fabric comprising an aqueous dispersion containing:

10% by weight of a polymeric resin binder selected from the group consisting of an acrylic resin, a polyvinyl chloride, a polyvinyl alcohol, a polyvinyl acetate, a polystyrene, and a mixture thereof;

10% by weight of a water dispersible thermosetting resin comprising an epoxy resin containing bisphenol-A or a blend of said epoxy resin containing bisphenol-A with another thermosetting resin which is not the same as said epoxy resin containing bisphenol-A; and 2% by weight of a delustrant, 2% by weight of an antistatic agent and 2% by weight of a surfactant.

10. Polyester fabric finished with the formaldehyde-free aqueous composition as claimed in claim 9.

11. A formaldehyde-free aqueous composition for finishing a polyester fabric comprising an aqueous dispersion containing:

20% by weight of a polymeric resin binder selected from the group consisting of an acrylic resin, a polyvinyl chloride, a polyvinyl alcohol, a polyvinyl acetate, a polystyrene, and a mixture thereof;

5% by weight of a water dispersible thermosetting resin comprising an epoxy resin containing bisphenol-A or a blend of said epoxy resin containing bisphenol-A with another thermosetting resin which is not the same as said epoxy resin containing bisphenol-A; and 2% by weight of a delustrant, 2% by weight of an antistatic agent and 2% by weight of a surfactant.

12. Polyester fabric finished with the formaldehyde-free aqueous composition as claimed in claim 1.

* * * * *

UNITED STATES PATENT AND TRADEMARK OFFICE

CERTIFICATE OF CORRECTION

PATENT NO. : 5,395,402

DATED : March 7,1995

INVENTOR(S) : Charles W. Duckett

It is certified that error appears in the above-indentified patent and that said Letters Patent is hereby corrected as shown below:

Claim 1, col.5, line 30, "10-15%" should read --10-50% --.

Signed and Sealed this

Twenty-fourth Day of October, 1995

*Attest:*

Bruce Lehman

BRUCE LEHMAN

*Attesting Officer*

*Commissioner of Patents and Trademarks*